US006727471B2

(12) United States Patent
Evans et al.

(10) Patent No.: US 6,727,471 B2
(45) Date of Patent: Apr. 27, 2004

(54) MODULAR FLEXIBLE HEATER SYSTEM WITH INTEGRATED CONNECTORS

(76) Inventors: Clarke B. Evans, 101 Mountain Vista La., Silverthorne, CO (US) 80498; Kevin R. Mallory, 9005 Green Mountain Rd., Cheyenne, WY (US) 82009

( * ) Notice: Subject to any disclaimer, the term of this patent is extended or adjusted under 35 U.S.C. 154(b) by 28 days.

(21) Appl. No.: 10/190,065

(22) Filed: Jul. 5, 2002

(65) Prior Publication Data

US 2004/0004066 A1 Jan. 8, 2004

(51) Int. Cl.[7] ..... H05B 3/34

(52) U.S. Cl. ..... 219/213; 219/549; 219/541; 392/435

(58) Field of Search ..... 219/213, 541, 219/528, 549; 392/435, 437; 439/106, 101

(56) References Cited

U.S. PATENT DOCUMENTS

| | | | | | |
|---|---|---|---|---|---|
| 2,546,743 | A | | 3/1951 | Harrison | |
| 2,844,696 | A | * | 7/1958 | Custer, Jr. | 219/213 |
| 3,129,316 | A | | 4/1964 | Glass et al. | |
| 3,691,343 | A | | 9/1972 | Norman | |
| 3,904,850 | A | * | 9/1975 | Johnson | 219/528 |
| 4,081,657 | A | | 3/1978 | Stanford | |
| 4,769,526 | A | | 9/1988 | Taouil | |
| 4,931,625 | A | * | 6/1990 | Marlinski | 219/528 |
| 5,282,236 | A | * | 1/1994 | Hayes et al. | 378/182 |
| 5,391,858 | A | | 2/1995 | Tourangeau et al. | |
| 5,451,743 | A | * | 9/1995 | Preez | 219/200 |
| 5,786,563 | A | | 7/1998 | Tiburzi | |
| 5,813,184 | A | | 9/1998 | McKenna | |
| 5,878,533 | A | | 3/1999 | Swanfeld, Jr. | |
| 6,015,965 | A | | 1/2000 | Miller et al. | |
| 6,166,352 | A | | 12/2000 | Turton | |
| 6,184,496 | B1 | * | 2/2001 | Pearce | 219/213 |
| 6,276,202 | B1 | | 8/2001 | Latarius | |
| 6,278,085 | B1 | * | 8/2001 | Abukasm | 219/213 |
| 6,293,811 | B1 | * | 9/2001 | Frantz | 439/101 |
| 6,294,768 | B1 | * | 9/2001 | Liebich | 219/528 |
| 6,383,003 | B1 | * | 5/2002 | Corona | 439/278 |

FOREIGN PATENT DOCUMENTS

| | | | | |
|---|---|---|---|---|
| DE | 2449676 | * | 4/1976 | |
| DE | 3609782 | * | 6/1987 | 392/437 |
| FR | 2698432 | * | 5/1994 | |
| JP | 4-71184 | * | 3/1992 | |
| JP | 9-63755 | * | 3/1997 | |
| JP | 10-323445 | * | 12/1998 | |
| NO | 65785 | * | 2/1943 | 392/437 |
| WO | 91/00037 | * | 1/1991 | |
| WO | 97/07652 | * | 2/1997 | |
| WO | 02/034094 | * | 5/2002 | |

* cited by examiner

*Primary Examiner*—John A. Jeffery
(74) *Attorney, Agent, or Firm*—Ancel W. Lewis, Jr.

(57) ABSTRACT

Heater system includes flexible heater modules connected by keyed quick connect connectors and connector cables. The heater modules include a heater element connected to two power wires, and an integrated ground layer. The connectors and connector cables connect heater elements together in an electrically parallel configuration and connect the ground layers together. The heater system design is independent of application and suitable for many construction applications.

11 Claims, 2 Drawing Sheets

MODULAR FLEXIBLE HEATER SYSTEM WITH INTEGRATED CONNECTORS

TECHNICAL FIELD

The present invention relates to heating systems and more particularly to a modular system of flat, flexible heater units each having an integrated ground layer and integrated connectors.

BACKGROUND ART

During the winter ice dams can form in rain gutters and on eaves that extend beyond the walls of a building. Ice patches form on driveways and outdoor walkways that are subject to freeze and thaw cycles. In cold climates heated floors or walls may be desirable.

Proposed solutions to the build up of ice dams include a row of heated shingles over the eaves, a heated roof drip edge and heated rain gutters. U.S. Pat. No. 2,546,743 to Harrison, U.S. Pat. No. 3,691,343 to Norman and U.S. Pat. No. 5,813,184 to McKenna disclose heated roofing shingles. U.S. Pat. No. 4,081,657 to Stanford discloses a heated roof drip edge strip, and U.S. Pat. No. 4,769,526 to Taouil discloses a heated roof drip edge strip with an integrated gutter guard. U.S. Pat. No. 5,878,533 to Swanfeld Jr. discloses a heated rain gutter, and U.S. Pat. No. 5,391,858 to Tourangeau et al. discloses a combination heated drip edge and heated gutter.

U.S. Pat. No. 5,786,563 to Tiburzi discloses rigid heated roof edge panels that extend over the rain gutters and have a valve that selectively allows water to drain into the gutters or over the panel edge beyond the gutters. The panels of Tiburzi can replace the lower shingles or the panels can be mounted over existing lower shingles. U.S. Pat. No. 3,129,316 to Glass et al. discloses a rigid heater panel suitable for mounting under shingles on the eave of a building. U.S. Pat. No. 6,166,352 to Turton discloses a flexible mat heater suitable for mounting under shingles on the eave of a building.

DISCLOSURE OF THE INVENTION

Modular heating system includes flat, flexible heater modules each having a non-conductive inner layer, first and second power wires and at least one heater element on one face of the inner layer and a ground layer on the other face of the inner layer. A non-conductive first outer layer covers the power wires and heater element, and a non-conductive second outer layer covers the ground layer. The first and second power wires extend across the inner layer. The first and second power wires, and the ground layer connect to terminals mounted along a first edge of the inner layer and connect at opposite ends to terminals mounted along a second edge of the inner layer, opposite the first edge. Adjacent heater modules connect together through molded connectors and heater modules at angles to each other connect together with flexible connectors. Each heater element connects at one end to the first power wire and at the opposite end to the second power wire.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
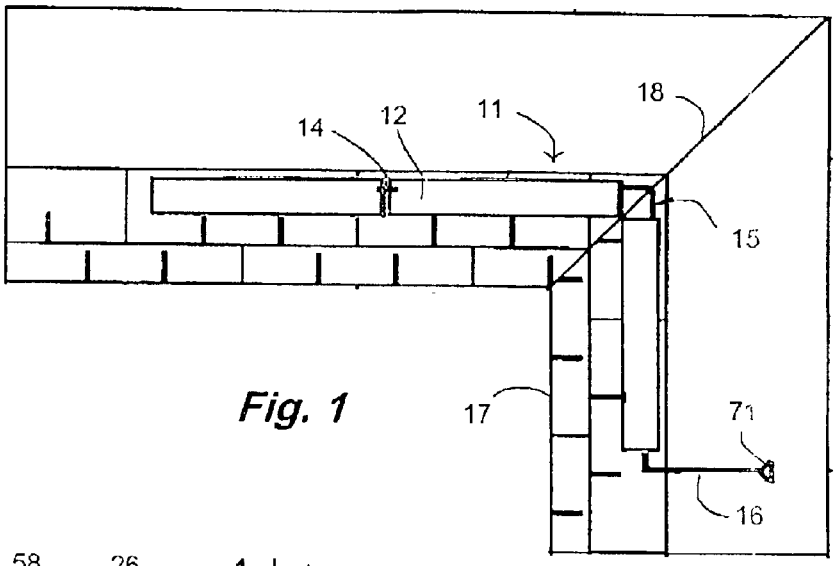
FIG. 1 is a top plan view of a heater system embodying features of the present invention.

Referring now to FIG. 1, a heater system 11 embodying features of the present invention includes a plurality of flexible heater modules 12. End by end modules 12 connect together with first connectors 14. Successive rows of modules 12 and modules 12 arranged at an angle to each other connect with connector cables 15. A power cord 16 connects to one module 12 and supplies power to the system 11. In the illustrated embodiment of FIG. 1, the system is shown in a roof heating application, mounted on the roof eaves 17 and extending across a roof valley 18.

Figure 2:
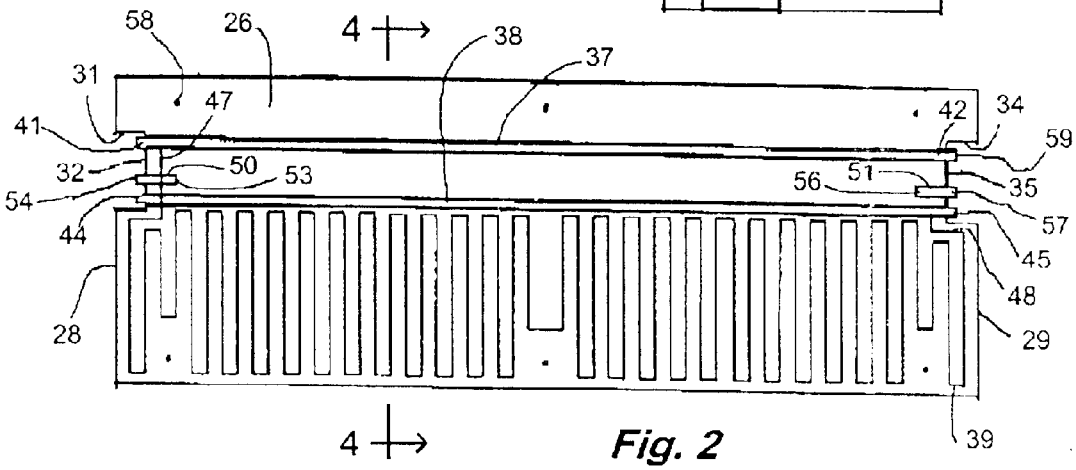
FIG. 2 is a top plan view of a heater module of the system of FIG. 1.
Figure 3:
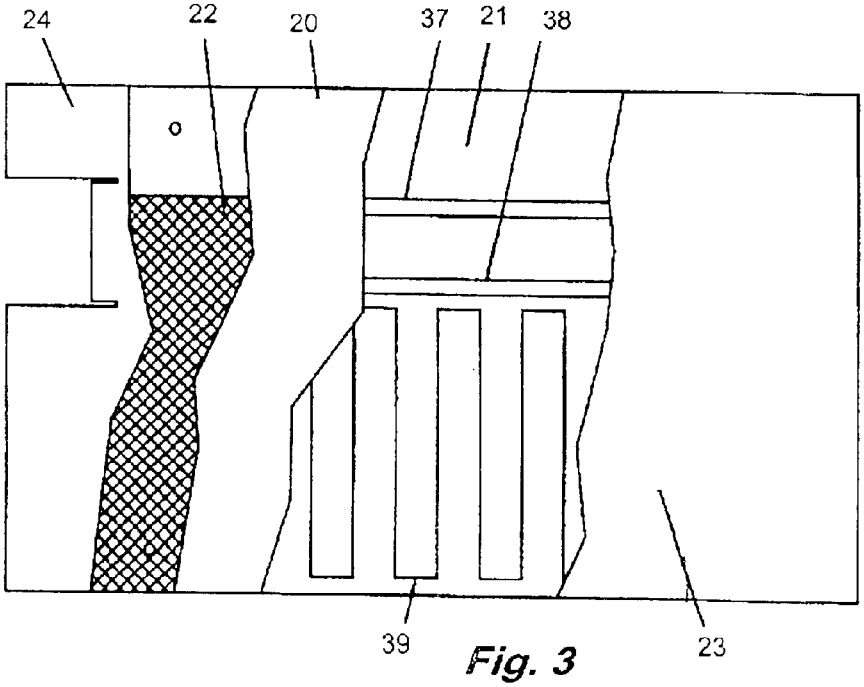
FIG. 3 is a top plan view, partially cut away, showing the layers of the heater module of FIG. 2.
Figure 4:
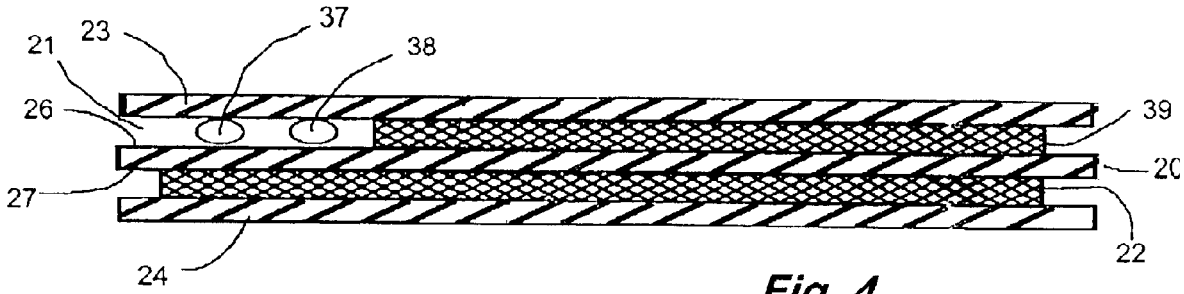
FIG. 4 is a sectional view taken along line 4—4 of FIG. 2.

As shown in FIGS. 2, 3 and 4, heater module 12 includes an inner layer 20, a heater layer 21, a ground layer 22, a first outer layer 23 and a second outer layer 24. The inner layer 20 has a flat, generally rectangular shape and is a flexible, non-conductive material. Inner layer 20 has a first face 26 and a spaced, oppositely facing second face 27. First edge 28 and second edge 29, bound the first and second faces 26 and 27 on opposite sides. A first recess 31 along the first edge 28 includes a first recess edge 32, parallel with and spaced inwardly from the first edge 28. A second recess 34 along the second edge 29, opposite the first recess 31, includes a second recess edge 35, parallel with and spaced inwardly from the second edge 29.

The heater layer 21 includes first power wire 37, second power wire 38 and a heater element 39, each attached to the first face 26 of the inner layer 20. The first power wire 37 extends across the first face 26, having a first end 41 at the first recess edge 32 and a second end 42 at the second recess edge 35. The second power wire 38 extends across the first face 26, in a parallel spaced relationship to the first power wire 37, and has a first end 44 at the first recess edge 32 and a second end 45 at the second recess edge 35. The heater element 39 mounts the first face 26 and has a first end 47 that connects to the first power wire 37 and a second end 48 that connects to the second power wire 38. Generally the heater element 39 extends over most of the area of the first face 26. In the illustrated embodiment, the heater element 39 is resistive wire in a serpentine configuration. Other configurations and other flexible materials, such as etched foil or conductive mat, are suitable for the present invention.

The ground layer 22 is flexible and is attached to the second face 27 of the inner layer 20. A first ground wire 50 has a first end 53 attached to the ground layer 22, and a second end 54 at the first recess edge 32, between the first end 41 of the first power wire 37 and the first end 44 of the second power wire 38. A second ground wire 51 has a first end 56 attached to the ground layer 22, and a second end 57 at the second recess edge 35, between the second end 42 of the first power wire 37 and the second end 45 of the second power wire 38.

The first end 41 of the first power wire 37, the second end 54 of the first ground wire 50, and the first end 44 of the second power wire 38 each terminate in a flat spade lug or male plug type quick connect first terminal 59 that extends outwardly beyond the first recess edge 32. The second end 42 of the first power wire 37, the second end 57 of the second ground wire 51, and the second end 45 of the second power wire 38 each terminate in a first terminal 59 that extends outwardly beyond the second recess edge 35. The spacing of the first terminals 59 along the first recess edge 32 is unequal to provide connector keying, as described hereinafter. The spacing of the first terminals 59 along the second recess edge 35 is unequal and is the same as the spacing of the first terminals 59 along the first recess edge 32.

The first outer layer 23 is a non-conductive material and is attached over the heater layer 21 and the first face 26 of the inner layer 20, sealing in the heater layer 20. The second outer layer 24 is a nonconductive material and is attached over the ground layer 22 and the second face 27 of the inner layer 20, sealing in the ground layer 22. The first and second outer layers 23 and 24 are recessed similar to the inner layer 20. The inner layer 20, first outer layer 23 and second outer 24 layer are each of a flexible, waterproof material, such as Mylar or silicone, and are preferably laminated together to seal in the heater layer 21 and the ground layer 22. By way of example, and not as a limitation, suitable materials include Compound 4129, Teknor Apex Company, Pawtucket, R.I. and Alcryn, Advanced Polymer Alloys Division, Ferro Corp., Wilmington, Del. In the illustrated embodiment, heater modules 12 are about 0.125 inch thick. A plurality of apertures 58 are provided that extend through the heater module 12, for fasteners to fasten the heater module 12 to a surface. The apertures 58 are provided to eliminate the risk of driving a fastener, such as a nail, through the heater element 39, the first power wire 37 or the second power wire 38.

Figure 5:
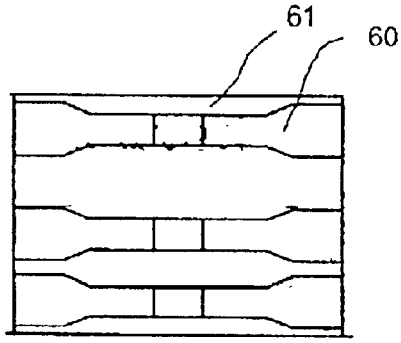
FIG. 5 is a top plan view of a connector for the system of FIG. 1
Figure 6:
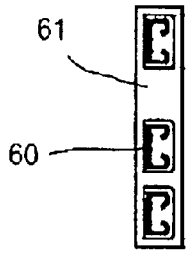
FIG. 6 is an end elevation view of the connector of FIG. 5.

Referring to FIGS. 5 and 6, first connector 14 includes three spaced, parallel pairs of spade lug receptacle second terminals 60. Each pair of second terminals 60 is connected together in an oppositely facing configuration. The spacing between the three pairs of second terminals 60 is unequal and is the same as the spacing of the first terminals 59 along the first recess edge 32. The second terminals 60 are molded into a first connector body 61.

Figure 7:
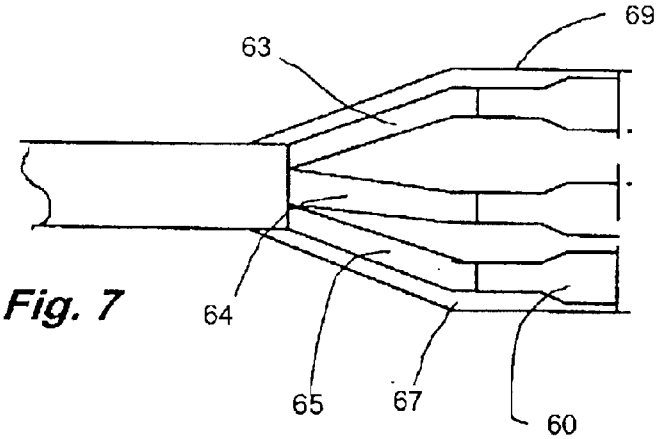
FIG. 7 is a top plan view of a connector cable for the system of FIG. 1
Figure 8:
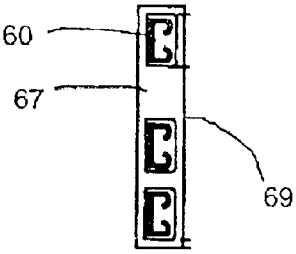
FIG. 8 is an end elevation view of the connector cable of FIG. 7.

As shown in FIGS. 7 and 8, a connector cable 15 includes first, second and third cable wires 63, 64 and 65 each terminating at both ends in a second terminal 60. The second terminals 60 at each end are molded in a spaced relationship into a connector housing 67, forming a second connector 69. The spacing of the second terminals 60 in the second connector 69 is the same as the spacing of the first terminals 59 along the first recess edge 32.

Referring to FIG. 1, power cord includes a conventional plug 71 at one end and a second connector 69 at the opposite end. The unequal spacing of the first terminals 59, and of the second terminals 60 in the first and second connectors 14 and 69 assures that the first power wires 37 in all the heater modules 12 are connected together, the second power wires 38 in all the heater modules 12 are connected together, and the ground layers 22 in all the heater modules 12 are connected together. In heater systems 11 designed for 240 VAC, the first and second power wires 37 and 38 are hot, whereas in heater systems designed for 120 VAC, the first power wire 37 is hot and the second power wire 38 is neutral.

The heater system 11 is preferably connected to an environmental controller. Such a controller can feed power to the heater system based on temperature, humidity, ice detection or on a timer, or combination of these factors. The heater modules 12 may be fabricated in any size and the heater elements 39 may be provided for any desired wattage, at 120 VAC or 240 VAC, for different applications. The heater system 11 may be used as, by way of example, and not as a limitation, under roof material heaters, exposed roof heaters, rain gutter heaters, floor heaters, walkway heaters, driveway heaters and wall heaters. As a rain gutter heater, heater system 11 would include heater modules 12 adhesively applied to the lower backside of the gutter and to the downspouts, with the heater modules 12 on the downspouts being electrically connected with a three way T-spice cable similar to connector cable 15.

The integrated ground layer 22 of the flexible heater modules 12 of the heater system 11 system of the present invention reduces the fire risk and electrical shock risk. The quick connect, keyed first and second connectors 14 and 69 simplify assembly and reduce construction costs. Since the heater elements 39 are connected electrically in parallel, the heater system 11 does not fail when a single heater element 39 fails.

Although the present invention has been described with a certain degree of particularity, it is understood that the present disclosure has been made by way of example and that changes in details of structure may be made without departing from the spirit thereof.

What is claimed is:

1. A heater module for a modular heating system comprising:

a flexible non-conductive inner layer having a flat first face and a spaced opposed second face, and a first edge and a spaced second edge opposite said first edge, a flexible heater layer mounted on said first face, said heater layer having first and second power wires each extending across said first face with said first power wire having a first end at said first edge and a second end at said second edge, and said second power wire having a first end at said first edge, spaced from said first end of said first power wire, and a second end at said second edge, near said second end of said first power wire, and a heater element mounted on said first face, and having a first end connected to said first power wire and a second end connected to said second power wire, a flexible ground layer mounted on said second face, a flexible non-conductive first outer layer mounted on said first face over and sealing in said heater layer, and a flexible non-conductive second outer layer mounted on said second face over and sealing in said ground layer.

2. The module as set forth in claim 1 wherein said heater element includes a resistive wire extending across said first face in a serpentine configuration.

3. The module as set forth in claim 1 including:

a first ground wire having a first end connected to said ground layer and a second end at said first edge and spaced from said first ends of said first and second power wires, and a second ground wire having a first end connected to said ground layer and a second end at said second edge and spaced from said second ends of said first and second power wires.

4. The module as set forth in claim 3 wherein:

said first edge includes a first recess with a first recess edge, said second edge includes a second recess with a second recess edge, said first end of said first power wire, said first end of said second power wire, and said second end of said first ground wire terminate in a male quick connect first terminals that extend outwardly from said first recess edge and are unequally spaced, and said second end of said first power wire, said second end of said second power wire, and said second end of said second ground wire terminate in a male quick connect first terminals that extend outwardly from said second recess edge and are unequally spaced.

5. A heater module for a modular heating system comprising:

a flexible non-conductive inner layer having a flat first face and a spaced opposed second face, and a first edge and a spaced second edge opposite said first edge, said first edge including a first recess with a first recess edge, said second edge including a second recess with a second recess edge, a flexible heater layer having first and second power wires, and a heater element, said first and second power wire each being mounted on and extending across said first face with said first power wire having a first end terminating in a male quick connect first terminal that extends outwardly from said first recess edge and a second end terminating in a male quick connect first terminal that extends outwardly from said second first recess edge, and said second power wire having a first end terminating in a male quick connect first terminal that extends outwardly from said first recess edge and is spaced from said first end of said first power wire, and a second end terminating in a male quick connect first terminal that extends outwardly from said second recess edge and spaced from said second end of said first power wire, said heater element being formed of resistive wire mounted across said first face in a serpentine configuration, and having a first end connected to said first power wire and a second end connected to said second power wire, a flexible ground layer mounted on said second face, a first ground wire having a first end connected to said ground layer and a second end terminating in a male quick connect first terminal that extends outwardly from said first recess edge, spaced unequally between said first ends of said first and second power wires, and a second ground wire having a first end connected to said ground layer and a second end terminating in a male quick connect first terminal that extends outwardly from said second recess edge, spaced unequally between said second ends of said first and second power wires, a flexible non-conductive first outer layer mounted on said first face over and sealing in said heater layer, and a flexible non-conductive second outer layer mounted on said second face over and sealing in said ground layer.

6. A modular heater system comprising:

flexible heater modules having a non-conductive inner layer having a flat first face and a spaced opposed second face, and a first edge and a spaced second edge opposite said first edge, a heater layer mounted on said first face, a ground layer mounted on said second face, a non-conductive first outer layer mounted on said first face over and sealing in said heater layer, and a non-conductive second outer layer mounted on said second face over and sealing in said ground layer, said heater layer having first and second power wires each extending across said first face with said first power wire having a first end at said first edge and a second end at said second edge, and said second power wire having a first end at said first edge, spaced from said first end of said first power wire, and a second end at said second edge, near said second end of said first power wire, and a heater element mounted on said first face, and having a first end connected to said first power wire and a second end connected to said second power wire, and a separable quick connect first connector configured to electrically connect adjacent said heater modules, and keyed to connect said heater layers to each other and to connect said ground layers to each other.

7. The system as set forth in claim 6 including a separable quick connect connector cable configured to electrically connect non-adjacent said heater modules, and keyed to connect said heater layers to each other and to connect said ground layers to each other.

8. The system as set forth in claim 6 wherein said heater element includes a resistive wire extending across said first face in a serpentine configuration.

9. The system as set forth in claim 6 wherein said heater module includes a first ground wire having a first end connected to said ground layer and a second end at said first edge and spaced from said first ends of said first and second power wires, and a second ground wire having a first end connected to said ground layer and a second end at said second edge and spaced from said second ends of said first and second power wires.

10. The system as set forth in claim 9 wherein:

said first edge includes a first recess with a first recess edge, said second edge includes a second recess with a second recess edge, said first end of said first power wire, said first end of said second power wire, and said second end of said first ground wire terminate in a male quick connect first terminals that extend outwardly from said first recess edge and are unequally spaced, and said second end of said first power wire, said second end of said second power wire, and said second end of said second ground wire terminate in a male quick connect first terminals that extend outwardly from said second recess edge and are unequally spaced, and said first connector includes three unequally spaced parallel pairs of oppositely facing female quick connect second terminals molded into a first connector body, said first connector body being sized and shaped to fit between said first and second recesses on adjacent said heater modules, and said spacing being selected to provide keyed connection between adjacent said heater modules.

11. A modular heater system comprising:

flexible heater modules having:

a flexible non-conductive inner layer having a flat first face and a spaced opposed second face, and a first edge and a spaced second edge opposite said first edge, said first edge including a first recess with a first recess edge, said second edge including a second recess with a second recess edge, a flexible heater layer having first and second power wires each mounted on and extending across said first face with said first power wire having a first end terminating in a male quick connect first terminal that extends outwardly from said first recess edge and a second end terminating in a male quick connect first terminal that extends outwardly from said second first recess edge, and said second power wire having a first end terminating in a male quick connect first terminal that extends outwardly from said first recess edge and is spaced from said first end of said first power wire, and a second end terminating in a male quick connect first terminal that extends outwardly from said second recess edge and is spaced from said second end of said first power wire, a ground layer mounted on said second face, a first ground wire having a first end connected to said ground layer and a second end terminating in a male quick connect first terminal that extends outwardly from said first recess edge, spaced unequally between said first ends of said first and second power wires, a second ground wire having a first end connected to said ground layer and a second end terminating in a male quick connect first terminal that extends outwardly from said second recess edge, spaced unequally between said second ends of said first and second power wires, a non-conductive first outer layer mounted on said first face over and sealing in said heater layer, and a non-conductive second outer layer mounted on said second face over and sealing in said ground layer, a separable quick connect first connector configured to electrically connect adjacent said heater modules, said first connector including three unequally spaced parallel pairs of oppositely facing female quick connect second terminals molded into a first connector body, said first connector body being sized and shaped to fit between said first and second recesses on adjacent said heater modules, and said pairs being spaced to provide keyed connection between adjacent said heater modules and keyed to connect said heater layers to each other and to connect said ground layers to each other, and a separable quick connect connector cable configured to electrically connect non-adjacent said heater modules, and keyed to connect said heater layers to each other and to connect said ground layers to each other.

* * * * *